US005993305A

United States Patent [19]

Chu

[11] Patent Number: 5,993,305

[45] Date of Patent: Nov. 30, 1999

[54] AIR-DRAFTING DUST REMOVER FOR POWER SANDER

[76] Inventor: Eric Chu, 8F-2, No. 153, Chung-San Road, Hsin-chu, Taiwan

[21] Appl. No.: 09/184,139

[22] Filed: Oct. 31, 1998

[51] Int. Cl.[6] ..... B24B 23/00; B24B 27/08

[52] U.S. Cl. ..... 451/357; 451/359; 451/451; 451/456

[58] Field of Search ..... 451/357, 359, 451/360, 353, 451, 453, 454, 455, 456, 457, 442, 87; 144/252

[56] References Cited

U.S. PATENT DOCUMENTS

| | | | |
|---|---|---|---|
| 4,058,936 | 11/1977 | Marton | 451/359 |
| 4,616,449 | 10/1986 | Marton | 451/456 |
| 5,074,081 | 12/1991 | Beth et al. | 451/344 |
| 5,105,585 | 4/1992 | Hampl et al. | 451/359 |
| 5,228,244 | 7/1993 | Chu | 451/344 |
| 5,237,781 | 8/1993 | Demetrius | 451/359 |
| 5,545,082 | 8/1996 | Courson et al. | 451/359 |
| 5,609,516 | 3/1997 | Courson et al. | 451/359 |
| 5,919,085 | 7/1999 | Izumisawa | 451/456 |

*Primary Examiner*—Derris Holt Banks

[57] ABSTRACT

A dust remover for power sander includes a dust collecting hood secured on the sander and fluidically communicated with a vacuum system formed in or attached to the sander, having a resilient bellows portion formed on a lower portion of the hood for covering a sanding pad as driven by a motor of the sander and a bottom flange having a plurality of apertures or perforations circumferentially formed in the flange, with the bellows portion resiliently expanding to retain the bottom flange on a working surface; whereby upon vacuum suction in the sander to form at least an air stream as drafted from the outside into the inside of the hood, the dusts, as produced when operating the sander, will be sucked inwardly into the hood as laden in the air stream to be finally collected and disposed for preventing air pollution and for enhancing occupational health.

10 Claims, 5 Drawing Sheets

FIG. 3
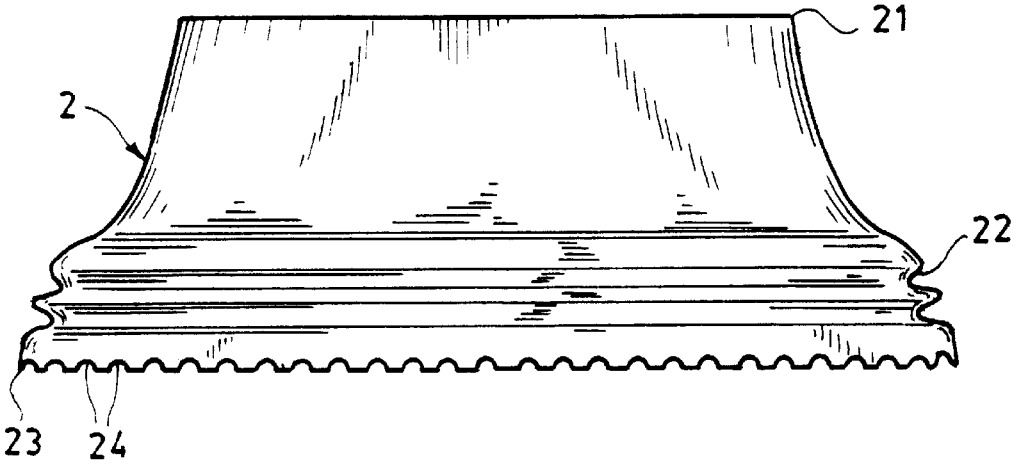
FIG. 3a
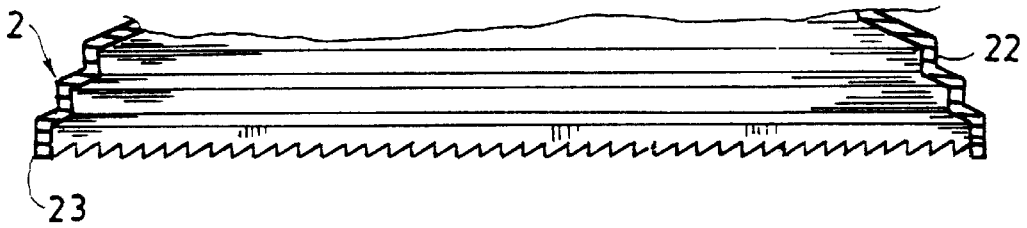
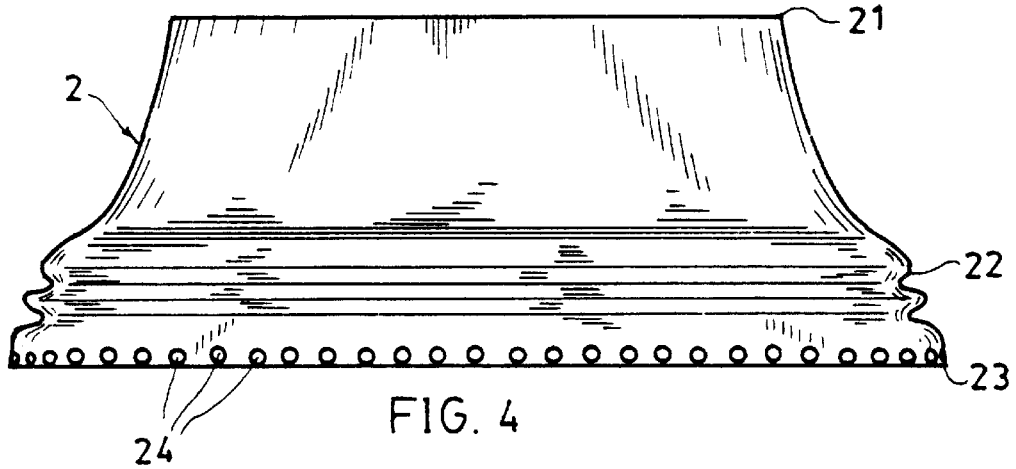
FIG. 4
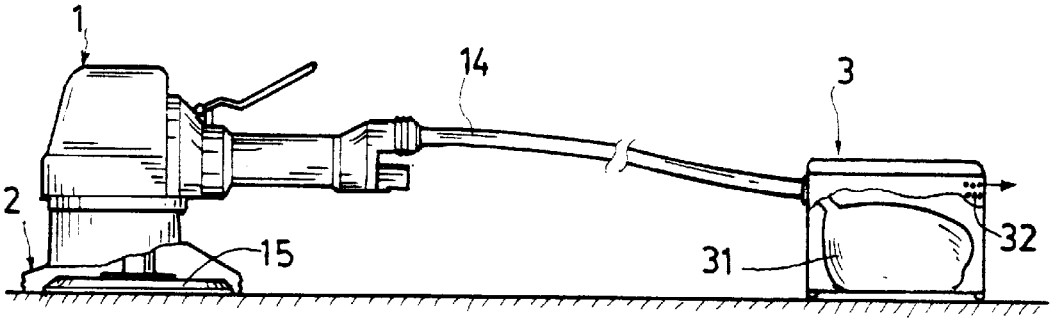
FIG. 4a

AIR-DRAFTING DUST REMOVER FOR POWER SANDER

BACKGROUND OF THE INVENTION

A conventional air sander S as shown in FIG. 1 includes a sanding pad P for sanding a surface W as driven by a pneumatic motor M by compressed air through inlet passage I, a hood H attached to and above the sanding pad P to form a chamber for directing dusts D as spread through the openings O drilled in the pad P by a suction or discharge tube T connected to air outlet E of the pneumatic motor M in order to suck or remove dust D occurring during the sanding operation.

However, as effected by the centrifugal force C of the rotating pad P, a great portion of the dusts will be spread centrifugally outwardly as shown in FIG. 1, still causing air pollution problem and hazard of occupational health to the operating workers.

The present inventor has found the drawbacks of the conventional air sander, and invented the present dust remover for power sander.

SUMMARY OF THE INVENTION

The object of the present invention is to provide a dust remover for power sander including a dust collecting hood secured on the sander and fluidically communicated with a vacuum system formed in or attached to the sander, having a resilient bellows portion formed on a lower portion of the hood for covering a sanding pad as driven by a motor of the sander and a bottom flange having a plurality of apertures or perforations circumferentially formed in the flange, with the bellows portion resiliently expanding to retain the bottom flange on a working surface; whereby upon vacuum suction in the sander to form at least an air stream as drafted from the outside into the inside of the hood, the dusts, as produced when operating the sander, will be sucked inwardly into the hood as laden in the air stream to be finally collected and disposed for preventing air pollution and for enhancing occupational health.

BRIEF DESCRIPTION OF THE DRAWINGS

FIG. 3 is a partial illustration of the dust collecting hood of the present invention.

FIG. 3*a* a shows another preferred embodiment of the dust-collecting hood of the present invention.

FIG. 4 shows still another preferred embodiment of the dust-collecting hood of the present invention.

FIG. 4*a* shows a dust collecting box connected to the sander of the present invention.

DETAILED DESCRIPTION

Figure 1:
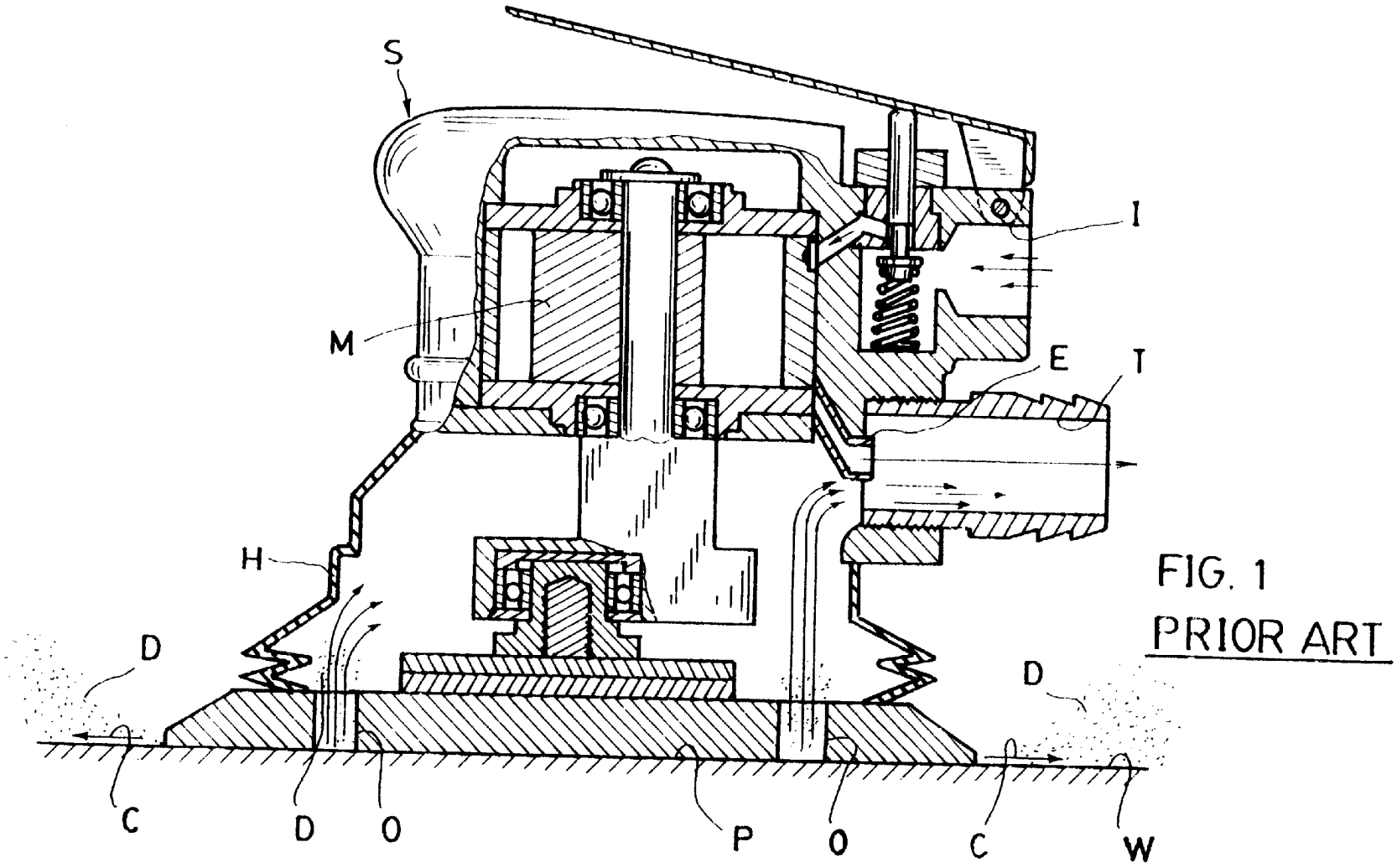
FIG. 1 PRIOR ART
FIG. 1 is an illustration showing a conventional air sander for dust collection.
Figure 2:
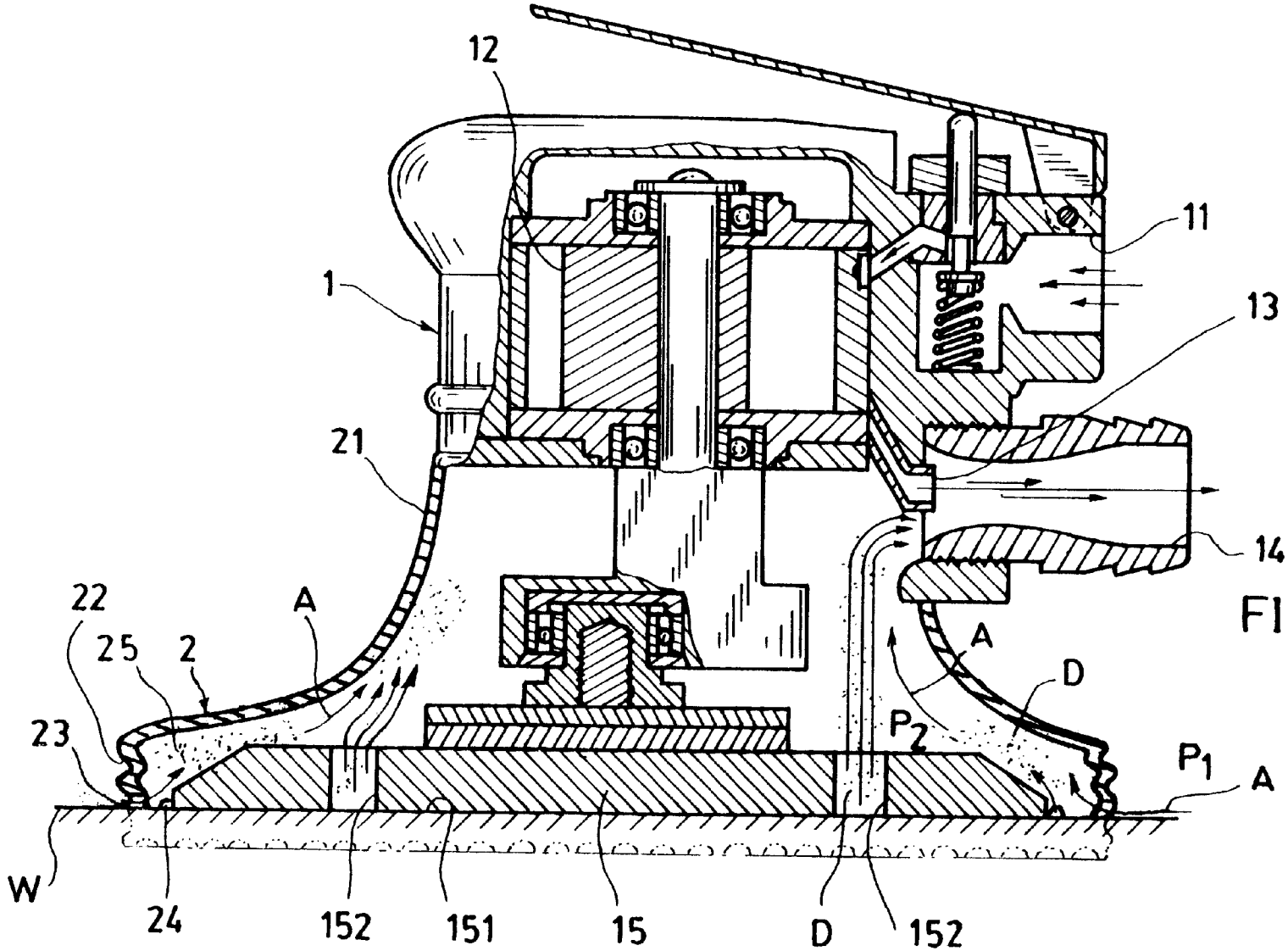
FIG. 2 is a sectional drawing of the present invention.

As shown in FIGS. 2 and 3, the dust remover for power sander of the present invention comprises a dust collecting hood 2 secured to a power sander 1 which may be a pneumatic sander as illustrated (or an electric sander driven by an electric motor). A vacuum suction system is inherently formed in the sander, or a sander such as a non-vacuum tool may be further connected with an additional vacuum suction system (not shown) for sucking and collecting dust from a hood of the sander for the disposal of dust.

The dust collecting hood 2 includes: an upper peripheral portion 21 secured to a lower portion of the sander 1, a resilient bellows portion 22 protruding downwardly from the upper peripheral portion 21 of the hood 2 for covering a sanding pad 15 as eccentrically rotated or oscillatorily driven by a motor such as a pneumatic motor 12 mounted in the sander and driven by a compressed air entered through an inlet air passage 11 as shown in FIG. 2, and a bottom flange 23 formed on a bottom edge of the bellows portion 22 and the hood 2 to be resiliently expanded beyond a bottom surface of the pad 15 to closely contact a grinding surface of a working piece W as urged by a resilience of the bellows portion 22 which may be made of elastomeric materials such as rubber or the like, having a plurality of apertures or perforations 24 circumferentially formed in the bottom flange 23, and having an air drafting passage 25 defined between the bellows portion 22 and the circumference of the sanding pad 15.

For increasing the resilience of the bellows portion 22 of the hood, an additional spring member (not shown) may be provided in the hood for ensuring a resilient "covering" of the bottom flange 23 of the hood on the working piece W for efficiently removing the dusts D during the sanding or grinding operation.

When directing compressed air into the sander 1 for rotating the motor 12, the pad 15 having sandpaper 151 adhered on its bottom will sand or grind the surface of the working piece W and having a plurality of openings 152 formed through the pad 15 for spreading dusts D upwardly through the openings 152; wherein the air exhausted from the air motor is discharged from air outlet 13 which is ejected into a Venturi tube of a tail (or discharge) tube 14, which is connected to a hose and a dust collecting bag 31 stored in a dust collecting box 3 having air-outlet holes 32 formed in the box 3 (FIG. 4*a*) for discharging exhausted air, to thus draft an air stream A through the air drafting passage 25 as defined between the hood 2 and the pad 15 to suck dusts D as laden in the air stream from the outside of the hood 2 into the interior of the hood.

The interior of the hood 2 is formed as a vacuum chamber having an inner negative pressure P2 less than the outer positive pressure (normal atmospheric pressure) P1 outside the hood 2 so that the air outside the hood 2 will be sucked inwardly through the apertures 24 formed in the bottom flange 23 of the hood to also suck the dusts D as laden in/on the air stream to be finally discharged through the tube 14 as shown in FIG. 2.

Due to the inward vacuum suction within the hood 2 to induce an air streamflow from outside the hood into the interior of the hood according to the present invention, the dust will be carried or drafted by the air streamflow to be efficiently removed from inside and outside of the hood to overcome the centrifugal thrusting and outward spreading of dusts as found in a conventional power sander.

Accordingly, the present invention provides a dust removing apparatus for power sander with higher dust collection efficiency than the prior arts, thereby serving a working environment with clean air without dust contamination for enhancing a better occupational health.

For non-vacuum type tool (sander), an additional vacuum suction system may be provided to connect a tail or discharge tube of a dust collecting hood of the tool to help sucking the air and the dusts laden thereon. A dust collector or collecting bag is provided for collecting the dusts for their final disposal.

Figure 7:
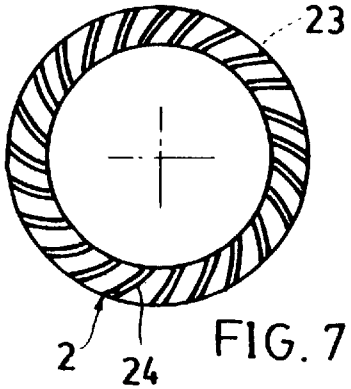
FIG. 7 is a cross sectional illustration of the bottom flange of the hood of the present invention.

The apertures 24 formed in the bottom flange 23 of the hood 2 may be corrugated shape or saw-toothed shape as shown in FIGS. 3, 3*a*. The apertures 24 may also be formed in the lower portion of the hood near the bottom edge of the hood as shown in FIG. 4. Other shapes such as circular shape or square-wave shape of the aperture 24 may be chosen in this invention as shown in FIGS. 4, 5, 6 or even cycloidal or spiral shape as shown in FIG. 7, not limited in the present invention.

Figure 5:
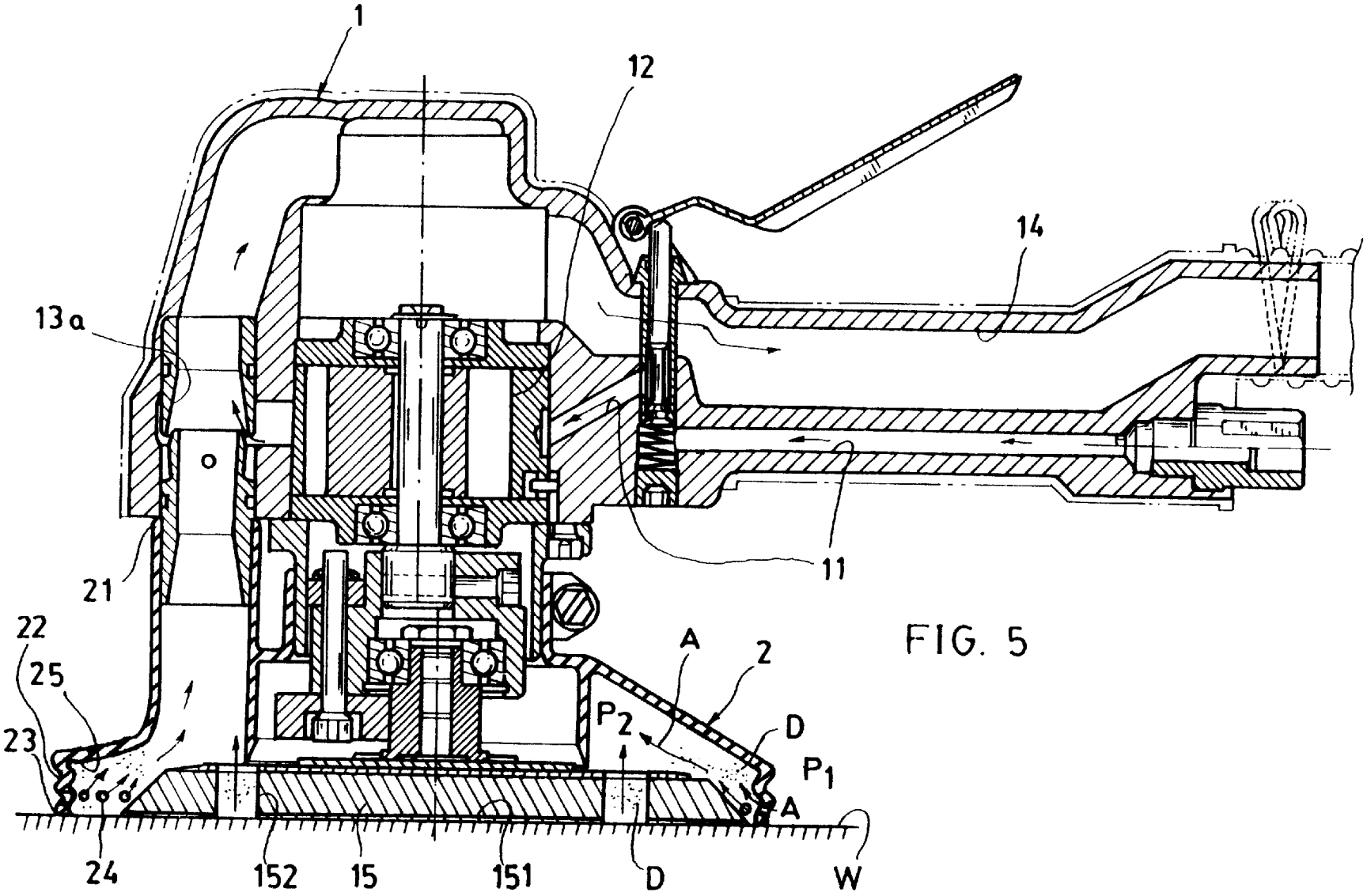
FIG. 5 shows further preferred embodiment of the present invention.

As shown in FIG. 5, the air outlet of the pneumatic motor 12 is formed on a side portion of the sander 1 having a throat 13*a* formed in a Venturi tube, whereby the air directed into the throat 13*a* towards the tail or discharge tube 14 will form a vacuum in the Venturi tube according to Bernoulli principle to thus draft the air from outside P1 (positive pressure) of the hood 2 into the interior P2 (negative pressure) in the hood 2 and to suck the dust as laden in the drafting air streams A to be discharged through the tail tube 14 and the hose (not shown) connected thereto.

Figure 6:
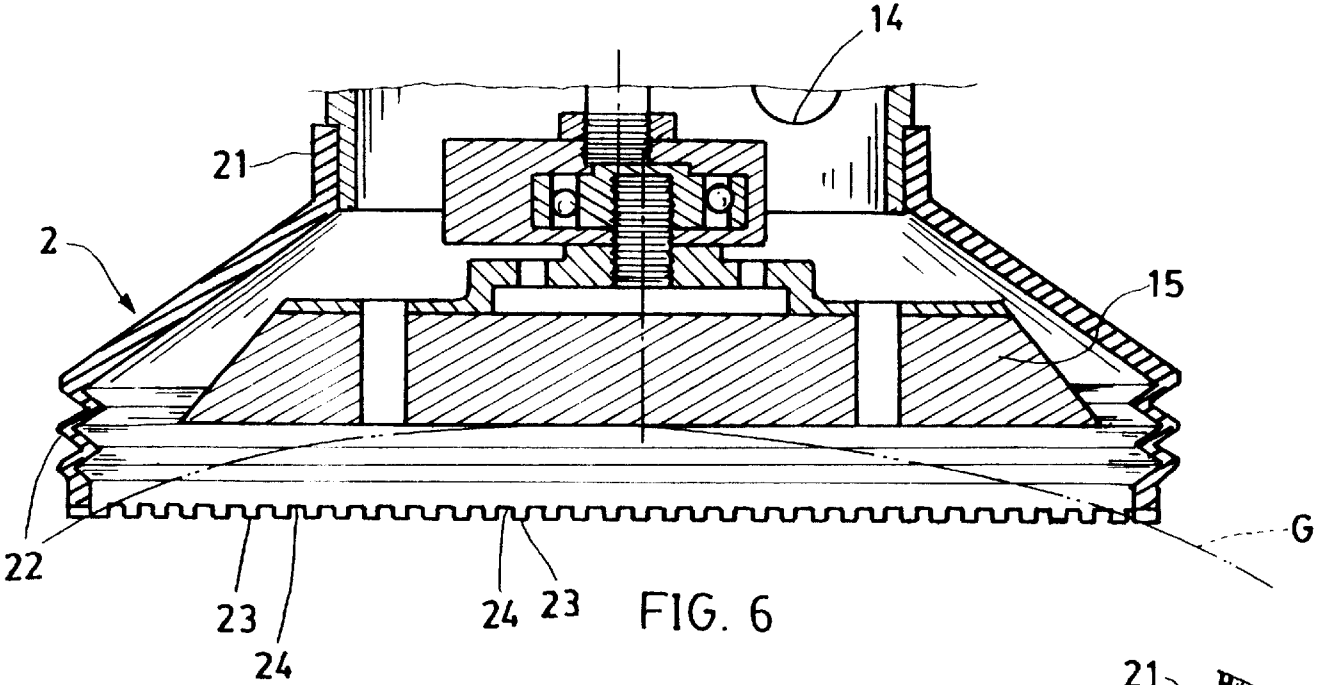
FIG. 6 shows still further preferred embodiment of the present invention.

The sander 1 may also be an electric sander having an electric motor provided therein for eccentrically rotating or oscillating the sanding pad 15 as shown in FIG. 6, in which the bottom flange 23 of the bellows portion 22 is resiliently expandable downwardly beyond a bottom of the pad 15 to allow the bottom flange 23 to well close or cover an arcuate or convex working piece (or surface) G as shown in phantom line of FIG. 6.

If for clear vision purpose, the hood 2 may be made of transparent elastomers, but not limited in the present invention.

The hood 2 may also be reinforced with reinforcing ribs (not shown) formed on the hood wall.

Figure 8:
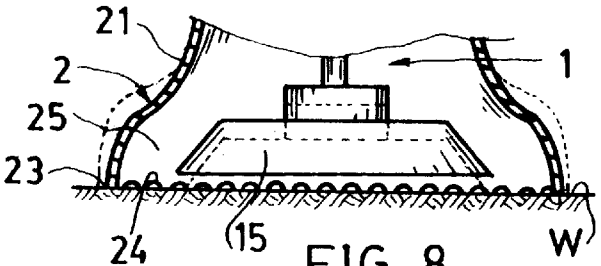
FIG. 8 shows the other form of the hood of this invention.

The hood 2 may also be formed as a bell or flare shape having its perforated bottom flange 23 gradually diverging downwardly from its upper peripheral portion 21. The bellows portion 22 as aforementioned will be omitted if the hood having good elasticity and flexibility as shown in FIG. 8 to allow the bottom flange 23 having apertures 24 formed therethrough to resiliently closely contact a grinding surface of working piece W for well dust removal.

The present invention may be modified without departing from the spirit and scope of this invention. The hood may be formed as other shapes besides the cylindrical shape as illustrated.

I claim:

1. A dust remover for power sander comprising a dust collecting hood secured to a power sander having a sanding pad operatively grinding a working piece with said sanding pad covered within said hood; said dust collecting hood made of elastomers and including a bellows portion protruding downwardly from an upper peripheral portion of said hood, and a bottom flange formed on a bottom of the bellows portion and resiliently contacting a grinding surface of the working piece, having a plurality of apertures circumferentially formed in the bottom flange, said bellows portion and said bottom flange of said hood defining an air drafting passage between said hood and said sanding pad; said hood, said sander and a discharge tube connected thereto being fluidically communicated with a vacuum suction system for forming at least an air stream drafted from outside of the hood, through the apertures formed in said bottom flange and discharging through said discharge tube of said sander, whereby upon operation of said sanding pad to produce dust adjacent to said sanding pad and upon suction of the vacuum suction system, the dust will be drafted as laden in the air stream and discharged through the air drafting passage and the discharge tube in said sander for an efficient dust removal of the sander.

2. A dust remover according to claim 1, wherein said bellows portion of said hood resiliently expands said bottom flange beyond a bottom surface of said sanding pad of said sander to closely contact the working piece.

3. A dust remover according to claim 1, said apertures of said bottom flange are continuously formed in the bottom flange on or adjacent to a bottom edge of said flange and selected from a corrugated shape, a saw-toothed shape, square-wave shape, a cycloidal and spiral shape and a ring shape consisting of apertures.

4. A dust remover according to claim 1, wherein said sander includes a pneumatic motor for driving said sanding pad for grinding a surface, and said vacuum suction system formed in said sander and including a Venturi tube having a throat formed adjacent to an air outlet of the pneumatic motor to be communicated between said air drafting passage and said discharge tube, whereby upon air entering in said sander and ejecting into said throat of said Venturi tube, a vacuum will be formed to suck air from outside of the hood, through the apertures in the bottom flange and the air drafting passage in said hood and to simultaneously draft dust as laden in the air as sucked by said Venturi tube for removing and collecting the dust.

5. A dust remover according to claim 1, wherein said hood has at least a reinforcing rib formed therein for reinforcing the hood.

6. A dust remover according to claim 1, wherein said hood is provided with a spring member therein to increase a resilience of said hood.

7. A dust remover according to claim 1, wherein said dust collecting hood is securable to a sander selected from a pneumatic sander driven by a pneumatic motor and an electric sander driven by an electric motor.

8. A dust remover for power sander according to claim 1, wherein said dust collecting hood is formed on a sander driven by an electric motor and said vacuum suction system is connectable to said hood and said sander for sucking and removing dust therefrom.

9. A dust remover according to claim 1, wherein said vacuum suction system includes a dust collecting box having a dust collecting bag stored in said box and connectable to said hood, and having a plurality of air outlet holes formed in said box for discharging air exhausted from the bag.

10. A dust remover for power sander comprising a dust collecting hood generally formed as a flare shape, and having an upper peripheral portion secured to a power sander having a sanding pad mounted therein, and a bottom flange gradually diverging downwardly from the upper peripheral portion to surround said sanding pad and to resiliently contact a working piece and to be positioned slightly beyond a bottom of said sanding pad for well covering a grinding surface of the working piece within said bottom flange of said hood, having a plurality of apertures circumferentially formed in said bottom flange; said hood made of elastomeric materials having good elasticity and flexibility; said sander communicated with a vacuum suction system; said hood defining an air drafting passage between said hood and said sanding pad for drafting an air stream from outside of said hood, through said apertures in said bottom flange, to enter the sander to suck dust laden in the air stream to be discharged by a discharge tube of said sander upon operation of the vacuum suction system.

* * * * *